US005096240A

United States Patent [19]

Schultz

[11] Patent Number: 5,096,240

[45] Date of Patent: Mar. 17, 1992

[54] LOCK ASSEMBLY FOR A PIVOTABLE WINDOW

[75] Inventor: Steven E. Schultz, Orland Park, Ill.

[73] Assignee: Ashland Products, Chicago, Ill.

[21] Appl. No.: 687,833

[22] Filed: Apr. 19, 1991

[51] Int. Cl.[5] ..... E05C 1/10

[52] U.S. Cl. ..... 292/153; 292/DIG. 38

[58] Field of Search ..... 292/32, 42, 153, 163, 292/175, 210, 285

[56] References Cited

U.S. PATENT DOCUMENTS

| | | | |
|---|---|---|---|
| 4,195,867 | 4/1980 | Baillie | 292/153 X |
| 4,475,311 | 10/1984 | Gibson | 292/153 X |
| 4,641,506 | 2/1987 | Boucher | 292/153 X |
| 4,669,765 | 6/1987 | Ullman | 292/153 |
| 4,837,975 | 6/1989 | Simpson | 292/175 X |

*Primary Examiner*—Richard E. Moore

*Attorney, Agent, or Firm*—Wallenstein, Wagner & Hattis, Ltd.

[57] ABSTRACT

A lock assembly for a window assembly. The window assembly has a window sash installed for reciprocal sliding movement within a window frame. The window sash includes a header frame member. The lock assembly comprises a housing and a finger disposed within the housing. The finger is adapted for sliding movement between an extended position wherein the finger engages the window frame and a retracted position wherein the finger avoids engagement with the window frame. The lock assembly further includes a lock button and a socket for receiving the lock button.

The lock button includes a cap and a generally hollow cylindrical body depending from the cap. The cylindrical body includes first and second radially opposing, projecting tongues. Each of the tongues is in spaced relationship with the cap to form respective first and second grooves. The lock button further includes a locking tab depending from one of the tongues for selective engagement with the finger to selectively prevent retraction of the finger.

The socket extends through the housing and defines an annular edge surface and first and second radially opposing notches. The lock button is rotated to a first position such that the first and second tongues are aligned with the first and second notches for insertion into the socket, and the lock button is rotated to a second position wherein the first and second grooves receive the edge surface.

12 Claims, 2 Drawing Sheets

LOCK ASSEMBLY FOR A PIVOTABLE WINDOW

TECHNICAL FIELD

The present invention relates to a slidable window mounted in a window frame, such as double hung, single hung and horizontally sliding windows, and, more particularly, to a lock assembly mounted on a sash of the window for selectively engaging the window frame to selectively permit or prohibit pivoting of the window sash.

BACKGROUND PRIOR ART

Slidable windows, such as double hung windows having upper and lower window sashes slidingly mounted in a window frame, are well known. Often the window sashes are pivotable, such as to permit cleaning of the exterior of the windows from the interior of a building. Such pivoting windows typically include a locking mechanism contained in a housing mounted on each header of the window sashes. The housing contains an extendable finger to selectively engage the window frame to selectively prevent pivoting of the window frame.

Often, a lock button extending through the housing is provided having a tab to selectively engage the finger to selectively maintain the finger in engagement with the window frame.

In many cases, the locking mechanism, including the housing, the finger and the lock button, are preassembled prior to shipment to the window manufacturer. Prior ones of such locking mechanisms would sometimes disassemble during shipment, with the lock button separating from the housing, resulting in waste. Further, prior ones of such locking mechanisms, once mounted on the window sash header, would disassemble upon impact with the window frame header. In addition, normal pressures exerted by the window operator could also cause disassembly of the mechanism.

The present invention is provided to solve these and other problems.

SUMMARY OF THE INVENTION

It is an object of the invention to provide a lock assembly for a window assembly.

In accordance with the invention, the window assembly has upper and lower window sashes installed for vertical reciprocal sliding movement within a window frame. The window sashes each include a respective header frame member.

The lock assembly comprises a housing and a finger disposed within the housing. The finger is adapted for sliding movement between an extended position wherein the finger engages the window frame and a retracted position wherein the finger avoids engagement with the window frame. The lock assembly further includes a lock button and a socket for receiving the lock button.

The lock button includes a cap and a generally hollow cylindrical body depending from the cap. The cylindrical body includes first and second radially opposing, projecting tongues. Each of the tongues is in spaced relationship with the cap to form respective first and second grooves. The lock button further includes a locking tab depending from one of the tongues for selective engagement with the finger to selectively prevent retraction of the finger. The socket extends through the housing and defines an annular edge surface and first and second radially opposing notches. The lock button is rotated to a first position such that the first and second tongues are aligned with the first and second notches for insertion into the socket, and the lock button is rotated to a second position wherein the first and second grooves receive the edge surface.

Other features and advantages of the invention will be apparent from the following specification taken in conjunction with the following drawings.

DETAILED DESCRIPTION

Figure 1:
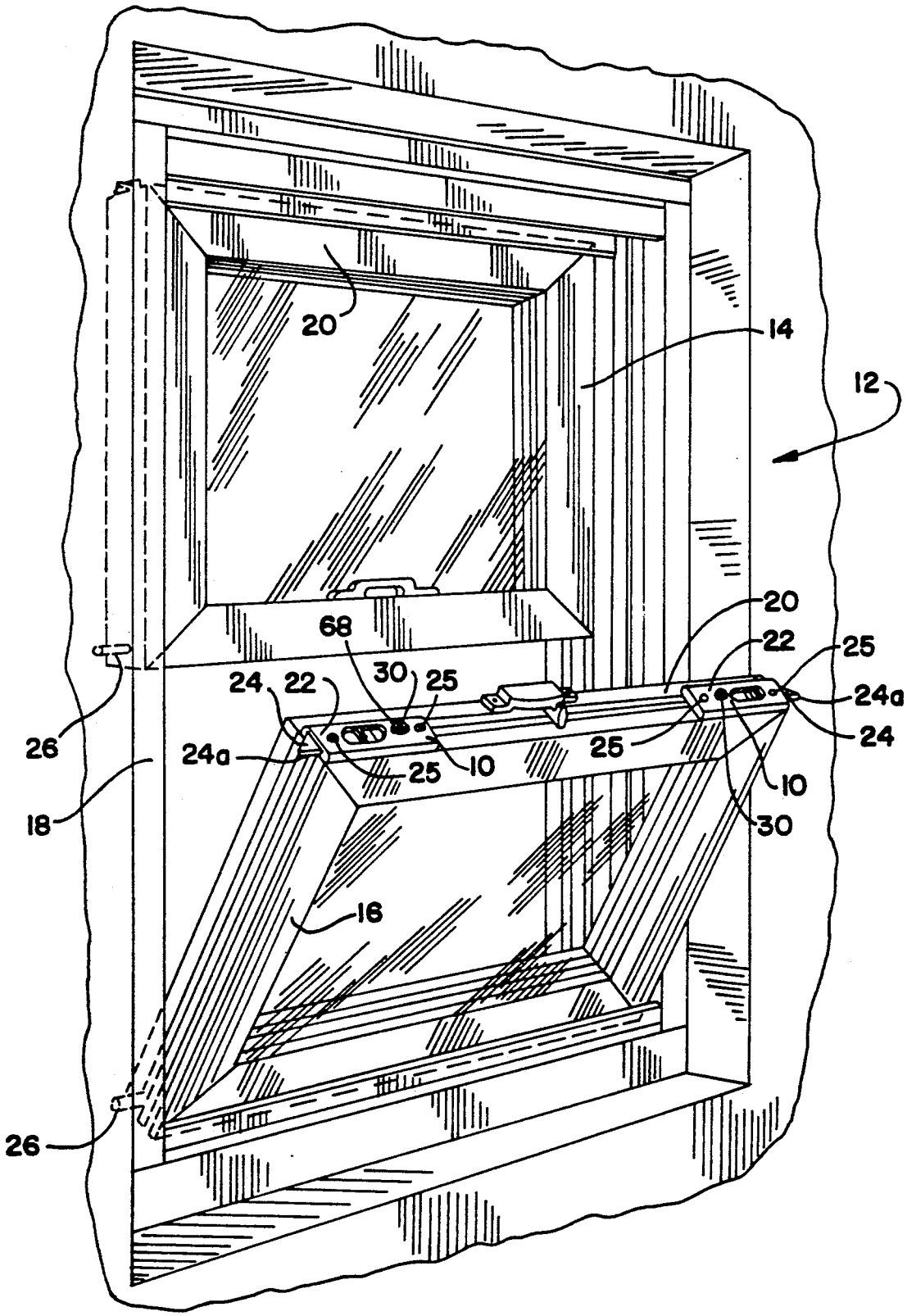
FIG. 1 is a perspective view of a typical, pivotable double hung window including a lock mechanism according to the invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A lock assembly, generally designated 10, for a window assembly, generally designated 12, is disclosed in FIG. 1. The lock assembly 10 is applicable to all slidable windows, though for purposes of illustration, the lock assembly 10 as mounted on a double hung window will be described.

The window assembly 12 has upper and lower window sashes 14,16, respectively, installed for vertical reciprocal sliding movement within a window frame 18. The window sashes 14,16, each include a respective header frame member 20.

The lock assembly 10 is formed of nylon, polycarbonate, or other suitable plastic. The lock assembly 10 comprises a housing 22 and a finger 24 disposed within the housing 22. Two of the lock assemblies 10 are provided for each of the window sashes 14,16, and are attached thereto by screws 25. Alternatively, the sashes 14,16 can include a custom outline to which the housing is attached by means of a snap fit.

Figure 2:
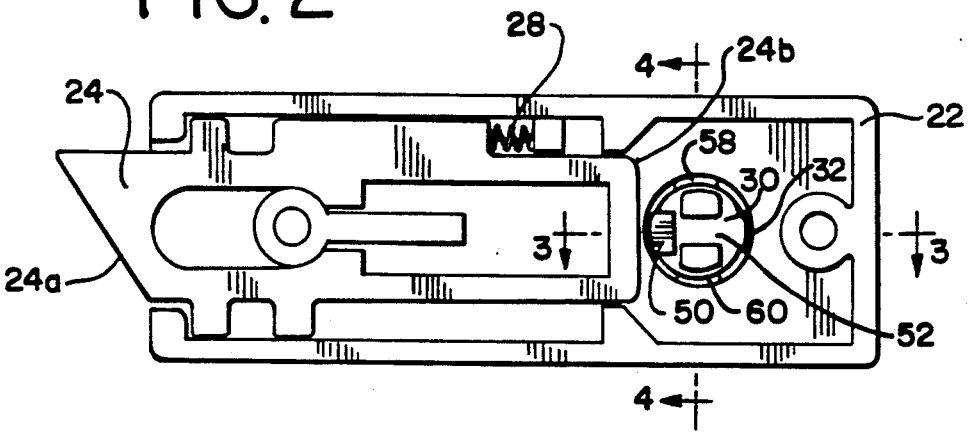
FIG. 2 is a bottom view of the lock mechanism of FIG. 1.
Figure 3:
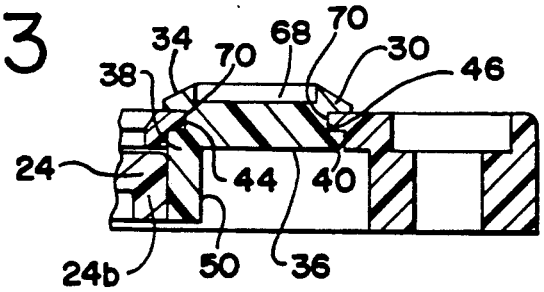
FIG. 3 is a sectional view of the lock mechanism taken along line 3—3 of FIG. 2.
Figure 4:
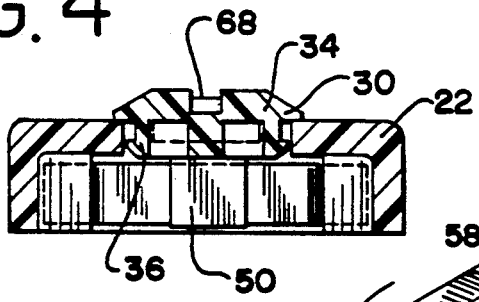
FIG. 4 is a sectional view of the lock mechanism taken along line 4—4 of FIG. 2.

The finger 24 is adapted for sliding movement between an outwardly extended position (as shown in FIGS. 1 and 2) wherein the finger 24 is extended for engagement with the window frame 18, and an inwardly retracted position wherein the finger 24 is retracted into the housing 22 to avoid engagement with the window frame 18. As is well known in the art, when engaged with the window frame 18, the extended finger 24 prevents pivoting of the window sashes 14,16 about pivots 26. As illustrated in FIG. 2, a spring 28 biases the finger 24 outwardly toward its extended position. The finger 24 includes a bevel **24*a* which causes the finger 24 to move inwardly against the bias of the spring 28 when the window sash is pivotally slammed shut. The spring 28 is optional, and can be omitted in certain instances, such as when the lock assembly 10** is only operated by trained personnel.

As illustrated in greater detail in FIGS. 2-5, the lock assembly 10 includes a lock button 30, and a socket 32 for receiving the lock button 30. The lock button 30 includes a cap 34 and a generally cylindrical body 36 depending from the cap 34. The body 36 can be solid or generally hollow, but a hollow body has been found preferable for manufacturing purposes. The cylindrical body 36 includes first and second radially opposing, projecting tongues 38, 40, respectively. Each of the tongues 38, 40, is spaced from the cap 34 to form respective first and second grooves 44, 46, respectively.

The lock button 30 further includes a locking tab 50 depending from the first tongue 38 for selective abutment with a back surface **24*b* of the finger 24. When the lock button 30 is rotatably positioned as shown in FIG. 2, the locking tab 50 prevents retraction of the finger 24. Alternatively, when the lock button 30 is rotated 180°, the finger 24 is free to retract, though it remains outwardly biased by the spring 28. A rib 52 extending across the hollow of the body 36 provides structural rigidity, such as to prevent the lock button 30 from popping out of the socket 32 upon impact of the back surface 24*b* of the finger 24 with the locking tab 50**.

The socket 32 extends through the housing 22 and defines opposing annular edge surfaces 54 and first and second radially opposing notches 58, 60, respectively. The edge surface 54 is undercut and forms a pair of opposing ring portions 64.

Figure 5:
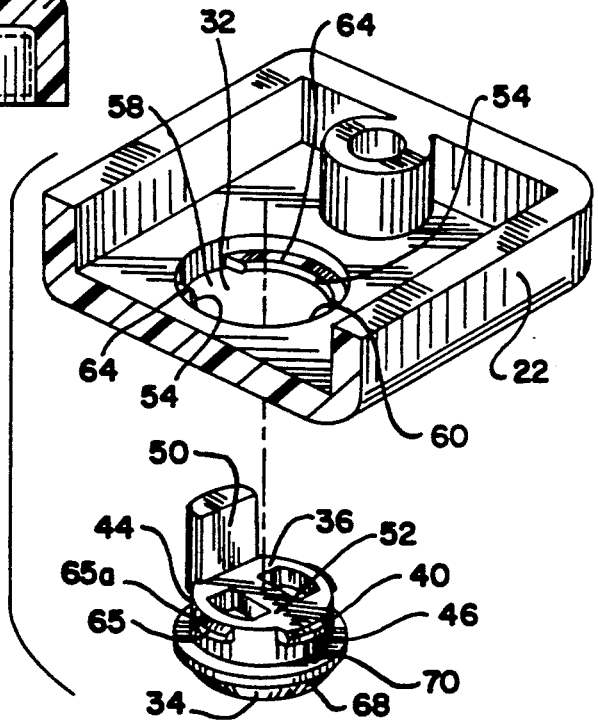
FIG. 5 is a perspective view of a lock button as utilized with the lock mechanism of the present invention.

The lock button 30 is inserted into the socket 32 by first rotating the lock button 30 to a first position such that the first and second tongues 38, 40, are aligned with the first and second notches 58, 60, for insertion into the socket 32, as shown in FIG. 5. The socket 32 has a diameter across the opposing edge surfaces 54 of 0.400". The lock button 30 includes a pair of retaining flanges 65 having 45° beveled surfaces **65*a*. The retaining flanges have a cross-sectional diameter of 0.420". Thus when the lock button 30 is inserted into the socket 32, the retaining flanges 65 inwardly deform, until they have cleared the edge surfaces 54, causing the lock button 30 to snap into place. Once inserted, the lock button 30 is rotated 90°, such as by inserting a screw driver into slot 68, wherein the first and second grooves 44, 46, securely receive the ring portions 64. Radial protrusions 70 formed in the grooves 44, 46 provide an interference fit to inhibit rotation of the inserted lock button 30 in the socket 32**, such as during shipment.

It will be understood that the invention may be embodied in other specific forms without departing from the spirit or central characteristics thereof. The present embodiment, therefore, is to be considered in all respects as illustrative and not restrictive, and the invention is not to be limited to the details given herein.

I claim:

1. A lock assembly for a slidable window assembly having a window sash installed for reciprocal sliding movement within a window frame, said window sash including a header frame member, said lock assembly comprising:

a housing;

means disposed within said housing for selectively engaging said window frame;

a lock button including a cap and a cylindrical body depending from said cap, said cylindrical body including a locking tab for selective engagement with said engaging means to selectively prevent retraction of said finger, said cylindrical body further including a radially projecting tongue spaced from said cap to form a groove;

a socket extending through said housing for receiving said lock button, said socket defining an annular edge surface and a radial notch, wherein said lock button is rotated to a first position such that said tongue is aligned with said notch for insertion into said socket and said lock button is rotated to a second position wherein said groove receives said edge surface.

2. The lock assembly of claim 1 wherein said socket includes a plurality of said notches and said lock button includes a corresponding plurality of said tongues.

3. The lock assembly of claim 2 wherein said body includes a rib extending between two of said tongues.

4. The lock assembly of claim 1 wherein said locking tab depends from said tongue.

5. The lock assembly of claim 1 wherein said body includes means for providing an interference fit with said socket.

6. The lock assembly of claim 5 wherein interference fit providing means comprises a radial protrusion disposed at said groove.

7. The lock assembly of claim 1 wherein said annular edge surface is undercut.

8. A lock assembly for a slidable window assembly having a window sash installed for reciprocal sliding movement within a window frame, said window sash including a header frame member, said lock assembly comprising:

a housing;

a finger disposed within said housing and adapted for sliding movement between an extended position wherein said finger engages said window frame and a retracted position wherein said finger avoids engagement with said window frame;

a lock button including a cap and a generally hollow cylindrical body depending from said cap, said cylindrical body including first and second radially opposing, projecting tongues, each of said tongues in spaced relationship with said cap to form respective first and second grooves, said lock button further including a locking tab depending from one of said tongues for selective engagement with said finger to selectively prevent retraction of said finger; and a socket extending through said housing for receiving said lock button, said socket defining an annular edge surface and first and second radially opposing notches, wherein said lock button is rotated to a first position such that said first and second tongues are aligned with said first and second notches for insertion into said socket and said lock button is rotated to a second position wherein said first and second grooves receive said edge surface.

9. The lock assembly of claim 8 wherein said body includes a rib extending between said first and second tongues.

10. The lock assembly of claim 8 wherein said body includes means for providing an interference fit with said socket.

11. The lock assembly of claim 10 wherein said interference fit providing means comprises a radial protrusion disposed at said first and second grooves.

12. The lock assembly of claim 8 wherein said annular edge surface is undercut.

* * * * *